US006902549B2

(12) United States Patent
Marmaropoulos et al.

(10) Patent No.: US 6,902,549 B2
(45) Date of Patent: Jun. 7, 2005

(54) FLUID-ADVANCING FIBER

(75) Inventors: George Marmaropoulos, Yorktown Heights, NY (US); Clive R. Van Heerden, Bronx, NY (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 457 days.

(21) Appl. No.: 10/186,701

(22) Filed: Jul. 1, 2002

(65) Prior Publication Data

US 2004/0000511 A1 Jan. 1, 2004

(51) Int. Cl.[7] ..... A61M 35/00
(52) U.S. Cl. ..... 604/289
(58) Field of Search ..... 604/289–291, 604/385.101, 891; 138/130; 210/321.79; 417/474–475, 322; 428/371; 324/106

(56) References Cited

U.S. PATENT DOCUMENTS 3,606,592 A * 9/1971 Madurski et al. ..... 417/413.1
3,677,667 A * 7/1972 Morrison ..... 417/474
4,917,579 A * 4/1990 Torma ..... 417/322
5,073,365 A * 12/1991 Katz et al. ..... 427/2.24
5,481,184 A * 1/1996 Jacobsen ..... 324/106
5,534,318 A 7/1996 Andre De La Porte et al. .. 428/36.9
5,693,230 A 12/1997 Asher ..... 210/650
6,230,501 B1 * 5/2001 Bailey et al. ..... 62/51.1
6,767,850 B1 * 7/2004 Tebbe ..... 442/76

FOREIGN PATENT DOCUMENTS

WO WO 2004048678 A1 * 10/2004 ..... D06M/23/12

* cited by examiner

*Primary Examiner*—Larry I. Schwartz
*Assistant Examiner*—Ginger T Chapman

(57) ABSTRACT

There is provided a fluid-advancing fiber capable of being sewn, woven or knitted, using conventional methods, into a conductive mesh for use with various wearable fabrics for making direct contact with the skin. The fluid-advancing fiber has an inner portion and an outer portion, one or more conductive elements adjacent the outer portion, wherein the one or more conductive elements are adapted to constrict when heated by electric current and relax when cooled. The fluid-advancing fiber facilitates comfortable fluid communication between different wearable fabrics and the skin.

20 Claims, 4 Drawing Sheets

FLUID-ADVANCING FIBER

1. FIELD OF THE INVENTION

The present invention relates to a fiber construction. More particularly, the present invention relates to a flexible, fluid-advancing fiber useable in various types of wearable fabrics.

2. DESCRIPTION OF THE PRIOR ART

It is known within the textile industry to combine the active principles of cosmetics, medicine, or health and fitness with various wearable fabrics. Also, it is known to provide different wearable fabrics with body temperature regulating systems. Typically, these wearable fabrics use encapsulated fluids or substances connected to one or more fibers and are configured to interact with the skin through wearing or rubbing contact. A significant drawback associated with these dual-purpose fabrics is there relatively short (typically 30 to 40 wash cycles) effective life. Consequently, there is a need for a more durable system for effectively retaining or advancing a fluid or substance through a flexible fiber network in a wearable fabric.

SUMMARY OF THE INVENTION

It is an object of the present invention to provide an improved fiber for use in wearable fabrics.

It is another object of the present invention to provide such a fiber configured to facilitate comfortable contact with skin.

It is still another object of the present invention to provide such a fluid-advancing fiber configured for advancing a fluid therethrough.

It is yet still another object of the present invention to provide such a fluid-advancing fiber capable of being woven, knitted, and/or sewn by conventional methods.

It is yet another object of the present invention to provide such a fluid-advancing fiber adapted to facilitate the effective and efficient advancement of a fluid throughout various wearable fabrics.

It is a further object of the present invention to provide such a fluid-advancing fiber adapted to facilitate the effective and efficient communication of a fluid between a wearable fabric and the skin of a user.

It is still a further object of the present invention to provide such a fluid-advancing fiber that enhances comfort and extends the effective life of wearable fabrics that integrating the active principles of cosmetics, medicine, health and fitness, and/or body temperature regulating systems.

These and other objects and advantages of the present invention are achieved by a fluid-advancing fiber of the present invention. This fluid-advancing fiber has an inner portion and an outer portion, one or more conductive elements adjacent the outer portion, wherein the one or more conductive elements are adapted to constrict when heated by electric current and relax when cooled. These fluid-advancing fibers can be intertwined using any known conventional method including weaving, sewing or knitting to form a durably flexible, comfortably wearable fabric.

BRIEF DESCRIPTION OF THE DRAWINGS

The present invention is more fully understood by reference to the following detailed description of a preferred embodiment in combination with the drawings identified below.

DETAILED DESCRIPTION OF THE INVENTION

Figure 1:
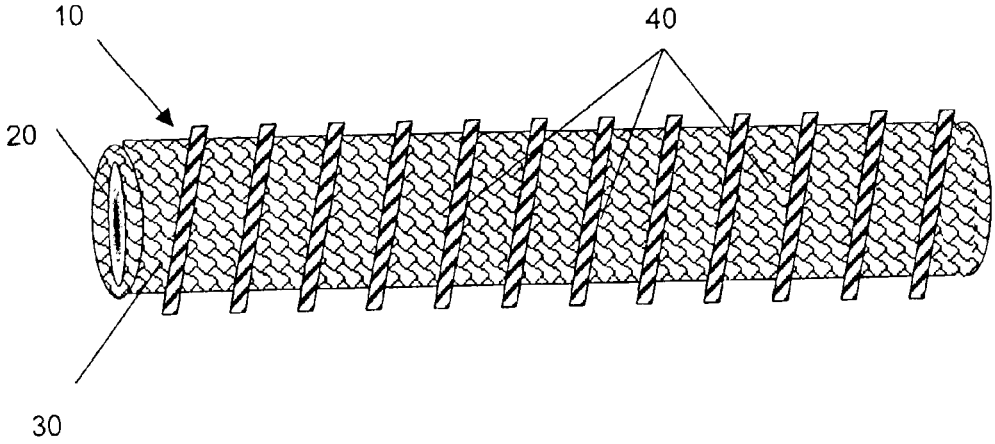
FIG. 1 is a longitudinal plan view of a first fluid-advancing fiber in accordance with a first illustrative embodiment of the present invention.
Figure 2:
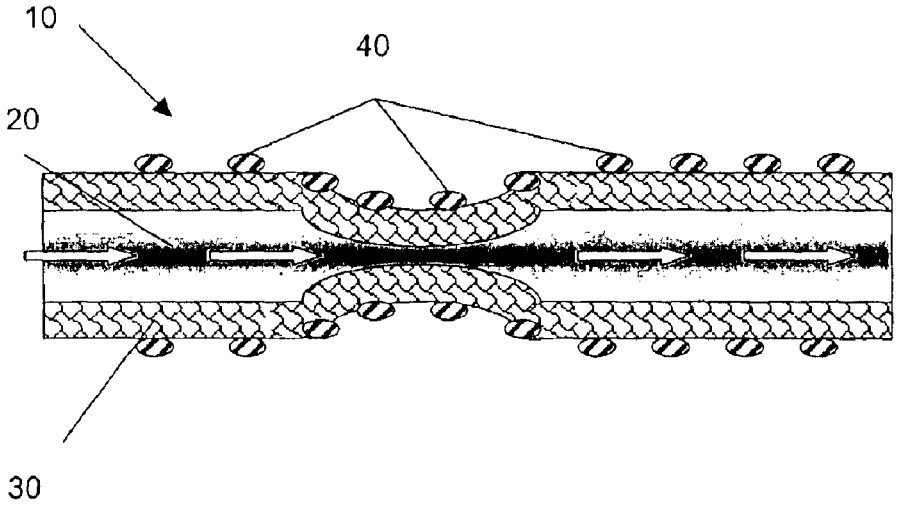
FIG. 2 is a longitudinal section view of the first fluid-advancing fiber showing fluid advancement in accordance the first illustrative embodiment.

Referring to the drawings and, in particular FIGS. 1 and 2, there is shown an improved fiber in accordance with a first illustrative embodiment of the present invention generally represented by reference numeral 10. Preferably, fluid-advancing fiber 10 has an inner portion 20 and an outer portion 30, and conductive elements 40 adjacent outer portion 30, wherein one or more conductive elements 40 are adapted to constrict when heated by electric current and relax when cooled.

Referring in particular to FIG. 2, preferably, inner portion 20 is hollow so as to allow a fluid or substance to pass or advance therethrough. It is noted that inner portion 20 can also be a solid material having sufficient permeability or porosity to allow a fluid or substance to advance therethough with minimal resistance, and sufficient flexibility to allow for the selective constriction thereof. Preferably, inner portion 20 is enclosed by outer portion 30 such that the fluid or substance can be retained therein and/or advanced therethrough. Thus, inner portion 20 preferably provides a passageway for effectively and efficiently retaining and/or advancing the fluid or substance through any wearable fabric incorporating one or more fluid-advancing fiber 10. It is noted that inner portion 20 need not be hollow, but can be any porous material capable of allowing fluid to be advanced therethrough.

Preferably, outer portion 30 is sufficiently permeable or porous to allow for the selective communication of a fluid or substance in inner portion 20 with the skin. Outer portion 30 can preferably be made of any suitable material providing sufficient permeance for the selective release of the fluid or substance in inner portion 20, and providing a sufficient degree of strength and flexibility during fabrication and wear. Thus, outer portion 30 preferably facilitates the effective and efficient advancement and/or release of a fluid or substance through and/or out of the fiber, respectively, for selective interaction with skin. It is noted that outer portion 30 need not be permeable and can be configured and/or formed of any material sufficient to facilitate different applications of use. For example, a fabric or similar structure capable of selectively applying various cosmetic products and/or therapies to the skin, a fabric or similar structure capable of selectively providing medical products and/or therapies to the skin, or a fabric or similar structure capable of regulating body temperature. Thus, inner portion 20 and outer portion 30 cooperate to form fluid advancing fiber 10 sufficient for use in various wearable fabrics designed for making contact with the skin and capable of being woven or sewn into a multitude of different patterns facilitating different applications in use.

Preferably, conductive elements 40 take the form of a wire made of a temperature sensitive memory alloy. Also, conductive elements 40 are preferably situated adjacent outer portion 30, such that when conductive elements 40 are heated by an electric current, the elements constrict. This constricting action can be used to advance a fluid or substance through inner portion 20 and/or to cause the fluid or substance to permeate outer portion 30 through the permeable or porous surface thereof to communicate and/or interact with skin near outer portion 30. Preferably, when conductive elements 40 cool in the absence of electric current, the elements return to their original shape and configuration. Thus, the selective heating and cooling of one or more conductive elements 40 preferably allows for the coordinated constriction and relaxation of outer portion 30 to advance the fluid or substance in inner portion 20. Also, one or more conductive elements 40 can preferably be selectively constricted to coordinate the selective release or permeation of the fluid or substance in inner portion 20 through outer portion 30. Thus, one or more conductive elements 40, preferably, allow for the selective fluid-communication between a fluid or substance, in fiber 10, and the skin. This fluid communication preferably facilitates a variety of different applications, such as for example, different cosmetic, medical, health and/or fitness therapies.

Preferably, fluid-advancing fibers 10 can be intertwined using any known conventional method for weaving, sewing or knitting and can be of any natural or man made material sufficient to accomplish the above discussed features. Fibers 10 can also preferably have different shapes and/or sizes so as to be incorporated into different wearable fabrics and/or fabric combinations to accommodate different uses.

Figure 3:
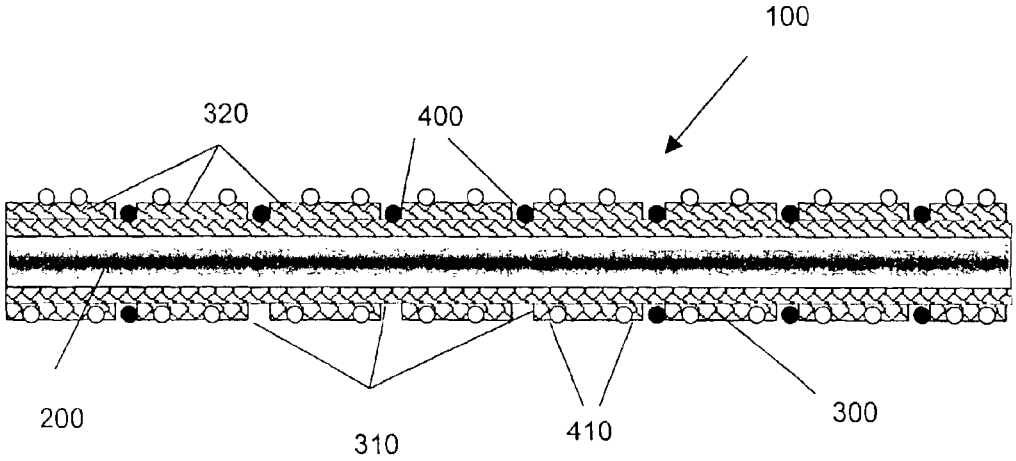
FIG. 3 is a longitudinal section view of a second fluid-advancing fiber in accordance with a second illustrative embodiment of the present invention.
Figure 4:
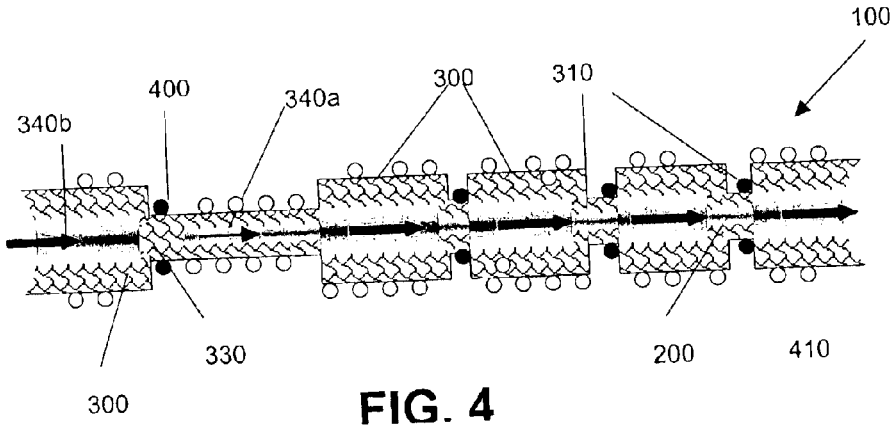
FIG. 4 is a longitudinal section view of the second fluid-advancing fiber showing a first stage of fluid advancement in accordance with the second illustrative embodiment.
Figure 5:
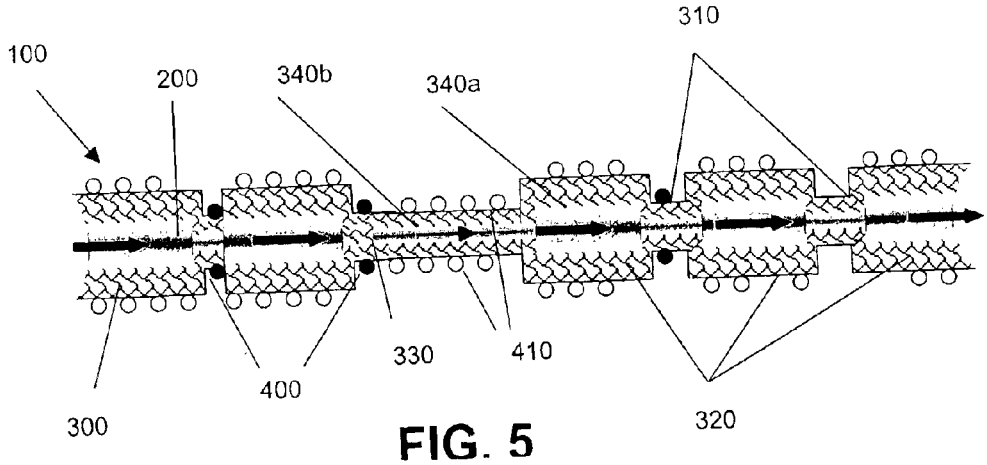
FIG. 5 is a longitudinal section view of the second fluid-advancing fiber showing a second state of fluid advancement in accordance with the second illustrative embodiment.

Referring to FIGS. 3 through 5, there is shown an improved fiber in accordance with a second illustrative embodiment of the present invention generally represented by reference numeral 100. Preferably, fluid-advancing fiber 100 has a fluid traversable inner portion 200, a flexibly durable outer portion 300, one or more first conductive elements 400, and one or more second conductive elements 410, wherein first conductive elements 400 and second conductive elements 410 are adapted to selectively constrict when heated by electric current and relax when cooled.

Preferably, inner portion 200 is hollow so as to allow a fluid or substance to pass or advance therethrough. It is noted that inner portion 200 can also be a solid material having sufficient permeability or porosity to allow a fluid or substance to advance therethough with minimal resistance, and sufficient flexibility to allow for the selective constriction thereof. Preferably, inner portion 200 is enclosed by outer portion 300 such that the fluid or substance can be retained therein and/or advanced therethrough. Thus, inner portion 200 preferably has substantially the same characteristics and capabilities as inner portion 20 identified and discussed above.

Preferably, outer portion 300 is sufficiently permeable or porous to allow for the selective communication of a fluid or substance in inner portion 200 with the skin. Outer portion 300 can preferably be made of any suitable material providing sufficient permeance for the selective release of the fluid or substance in inner portion 200, and providing a sufficient degree of strength and flexibility during fabrication and wear. Thus, outer portion 300 preferably has essentially the same characteristics and capabilities as outer portion 30 identified and discussed above. Outer portion 300 is distinct in that it preferably has one or more undulations 310 distantly spaced along outer portion 300.

Preferably, both first conductive elements 400 and second conductive elements 410 take the form of wires made of a temperature sensitive memory alloy. Preferably, first conductive elements 400 are adjacent undulations 310 and second conductive elements 410 are adjacent outer portion 300 along a distance 320 between the undulations. When first conductive elements 400 are heated by an electric current, the elements constrict. This constricting action causes undulations 310 to act as flow valves 330 for, as shown in FIG. 4, selectively controlling the advancement of a fluid or substance through inner portion 200. Once one or more valves 330 are closed, second conductive elements 410 can be selectively heated by an electric current causing one or more distances 320 between undulations 310 to be squeezed or constricted. This constricting action preferably causes one or more liquid or substance portions (340*a*, 340*b*) to be advanced. Preferably, when conductive elements 400 and 410 are cooled in the absence of electric current, the elements return to their original shape and configuration. Thus, preferably first conductive elements 400 and second conductive elements 410 cooperate in a synchronized manner to selectively advance the fluid or substance in inner portion 200. In addition, one or more conductive elements 410 can preferably be selectively constricted to coordinate the selective release or permeation of the fluid or substance in inner portion 200 through outer portion 300. One or more conductive elements 400 and 410, preferably, allow for the selective fluid-communication between a fluid or substance, in fiber 100, and the skin. This fluid communication preferably facilitates a variety of different applications, such as for example, different cosmetic, medical, and health and/or fitness therapies.

Preferably, fluid-advancing fibers 100 can be intertwined using any known conventional method for weaving, sewing or knitting and can be of any natural or man made material sufficient to accomplish the above discussed features. Fibers 100 can also preferably have different shapes and/or sizes so as to be incorporated into different wearable fabrics and/or fabric combinations to accommodate different uses.

The present invention having been thus described with particular reference to the preferred forms thereof, it will be obvious that various changes and modifications may be made therein without departing from the spirit and scope of the present invention as defined herein.

What is claimed is:

1. A fluid-advancing fiber comprising:

a fiber having an inner portion and an outer portion and being incorporable into a fabric;

one or more first conductive elements adjacent said outer portion of said fiber, wherein said one or more first conductive elements is/are adapted to constrict when heated by electric current and relax when cooled such constriction and relaxation causing fluid to advance along the fiber.

2. The fluid-advancing fiber of claim 1, wherein said inner portion is hollow to allow a fluid to advance therethrough.

3. The fluid-advancing fiber of claim 1, wherein said inner portion is sufficiently permeable to allow a fluid or substance to advance therethrough with minimal resistance.

4. The fluid-advancing fiber of claim 2, wherein said outer portion is sufficiently permeable to allow said fluid in said inner portion to permeate and interact with the skin.

5. The fluid-advancing fiber of claim 4, wherein said one or more first conductive elements are adapted to be selectively heated and cooled to coordinate said constriction and relaxation thereof for advancing said fluid or substance through said inner portion.

6. The fluid-advancing fiber of claim 4, wherein said outer portion has one or more undulations.

7. The fluid-advancing fiber of claim 6, further comprising one or more second conductive elements.

8. The fluid-advancing fiber of claim 7, wherein said one or more first conductive elements are adjacent said one or more undulations.

9. The fluid-advancing fiber of claim 8, wherein said one or more undulations is/are spaced at a distance one after another.

10. The fluid-advancing fiber of claim 9, wherein said one or more second conductive elements is/are adjacent said outer portion (30, 300) along said distance between said one or more undulations.

11. The fluid-advancing fiber of claim 10, wherein said one or more second conductive elements are adapted to constrict when heated by electric current and relax when cooled.

12. The fluid-advancing fiber of claim 11, wherein said one or more first conductive elements and said one or more second conductive elements are adapted to be selectively heated and cooled to coordinate said constriction and relaxation thereof for advancing said fluid or substance through said inner portion and/or selectively releasing said fluid or substance through said outer portion to interact with the skin.

13. A method for circulating a fluid or substance through a fiber comprising:

providing a fiber having an inner portion, an outer portion, and one or more first conductive elements adjacent said outer portion, said fiber being incorporable into a fabric and said one or more first conductive elements being adapted to constrict when heated by electric current and relax when cooled, and advancing said fluid or substance through said inner portion of said fiber by the selectively heating and cooling of said one or more first conductive elements to coordinate said constriction and relaxation thereof.

14. The method for circulating a fluid or substance through the fiber of claim 13, wherein said inner portion is sufficiently permeable to allow a fluid or substance to advance therethrough with minimal resistance and said outer portion is sufficiently permeable to allow said fluid in said inner portion to permeate and interact with the skin.

15. The method for circulating a fluid or substance through the fiber of claim 14, wherein said one or more first conductive elements are adapted to be selectively heated and cooled to coordinate said constriction and relaxation thereof.

16. The method for circulating a fluid or substance through the fiber of claim 15, further comprising the step of providing one or more second conductive elements and providing said outer portion with one or more undulations.

17. The method for circulating a fluid or substance through the fiber of claim 16, wherein said one or more first conductive elements is/are adjacent said one or more undulations, and wherein said one or more undulations is/are spaced at a distance one after another.

18. The method for circulating a fluid or substance through the fiber of claim 17, wherein said one or more second conductive elements is/are adjacent said outer portion along said distance between said one or more undulations.

19. The method for circulating a fluid or substance through the fiber of claim 18, wherein said one or more second conductive elements are adapted to constrict when heated by electric current and relax when cooled such that, when said one or more first conductive elements are selectively heated causing said undulations to act as flow valves, said one or more second conductive elements are coordinately heated and cooled to constrict and relax to advance said fluid or substance through said inner portion from one distance to and/or selectively release said fluid or substance through said outer portion to interact with the skin.

20. The method for circulating a fluid or substance through the fiber of claim 19, wherein said coordinated constricting action of said first one or more conductive element and said second conductive elements causes on or more fluid or substance portions to be advanced.

* * * * *